United States Patent [19]

Milliman

[11] Patent Number: 4,774,929

[45] Date of Patent: Oct. 4, 1988

[54] GUN WITH PIVOTING BARREL AND LEVER FOR RETAINING BARREL IN POSITION OR PERMITTING BARREL TO PVIOT

[75] Inventor: Keith L. Milliman, Fairport, N.Y.

[73] Assignee: The Coleman Company, Inc., Wichita, Kans.

[21] Appl. No.: 917,015

[22] Filed: Oct. 9, 1986

[51] Int. Cl.[4] ..... F41B 11/06

[52] U.S. Cl. ..... 124/76; 42/44; 124/83

[58] Field of Search ..... 124/40, 66, 67, 68, 124/74, 76, , 82, 83; 42/12, 44, 45

[56] References Cited

U.S. PATENT DOCUMENTS

| | | | |
|---|---|---|---|
| 139,391 | 5/1873 | Horr | 124/67 |
| 171,442 | 12/1875 | Sneider et al. | 42/44 |
| 1,545,465 | 7/1925 | Johnstone et al. | 124/67 |
| 2,364,232 | 12/1944 | Mills | 42/44 |
| 3,889,829 | 6/1975 | Dutton | 403/146 X |
| 3,924,599 | 12/1975 | Hammond | 124/40 X |
| 4,192,622 | 3/1980 | Stecklein | 403/146 |

FOREIGN PATENT DOCUMENTS

| | | |
|---|---|---|
| 824160 | 12/1951 | Fed. Rep. of Germany . |
| 3301542 | 8/1984 | Fed. Rep. of Germany . |
| 1557365 | 1/1969 | France . |

*Primary Examiner*—Richard T. Stouffer

[57] ABSTRACT

A gun is provided with a pivoting barrel and a cocking and retaining lever which cocks the hammer and retains the barrel in the firing position. When the lever moves to the unlocking position, the barrel is released and the hammer is cocked. When the barrel is loaded, the barrel is pivoted back to the firing position and the lever is moved to the position to retain the barrel.

11 Claims, 4 Drawing Sheets

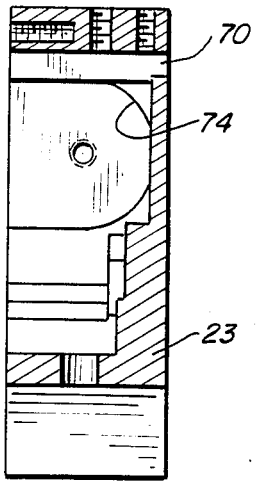
FIG. 10
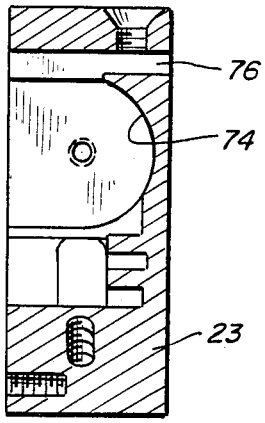
FIG. 11
FIG. 17
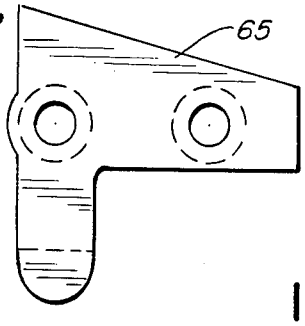
FIG. 18
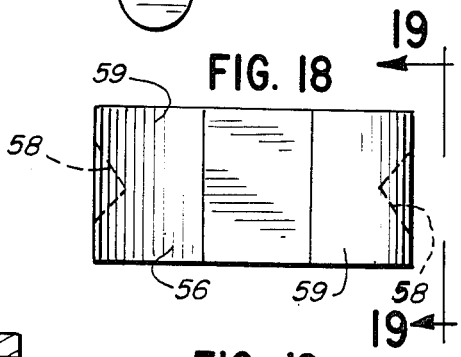
FIG. 12
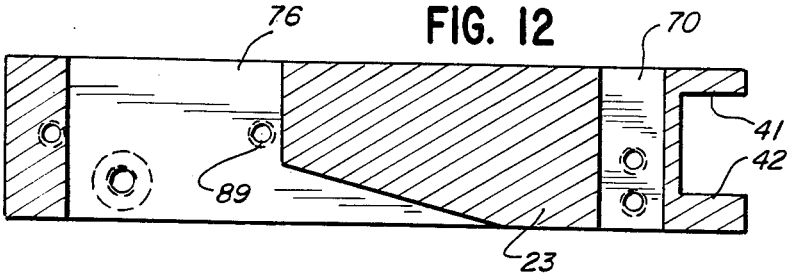
FIG. 19
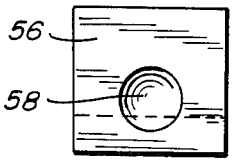
FIG. 14
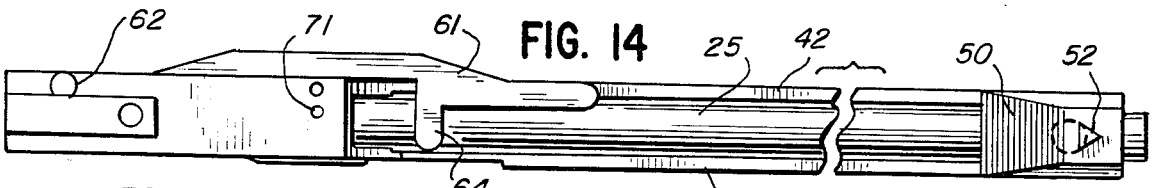
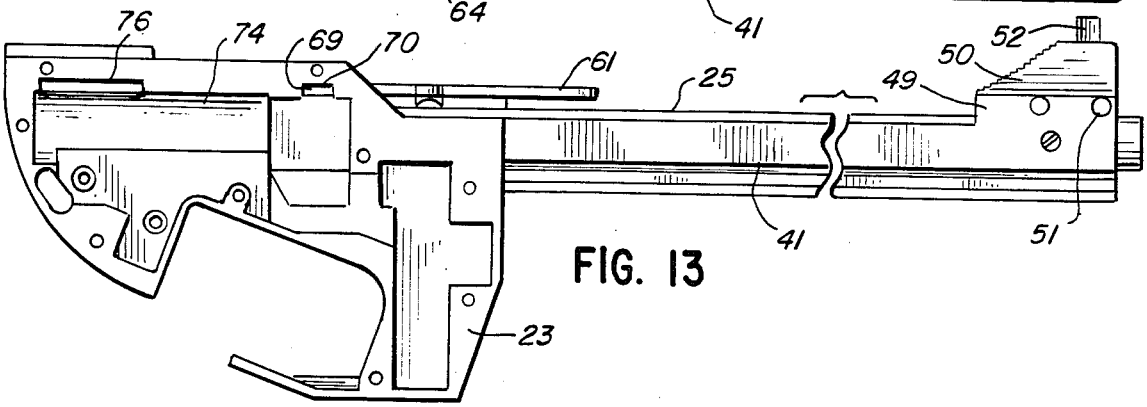
FIG. 13
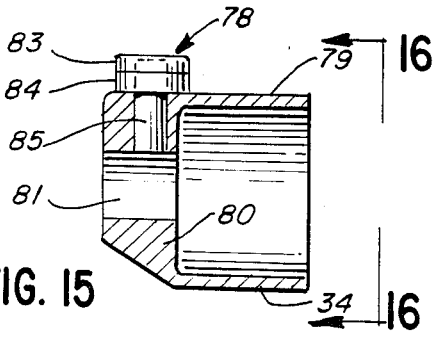
FIG. 15
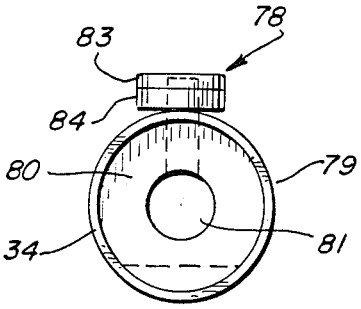
FIG. 16

GUN WITH PIVOTING BARREL AND LEVER FOR RETAINING BARREL IN POSITION OR PERMITTING BARREL TO PVIOT

BACKGROUND AND SUMMARY

This invention relates to guns, and, more particularly, to a gun which is equipped with a pivoting barrel and a cocking mechanism for cocking the gun and retaining the barrel in the firing position.

Airguns have often incorporated pivoting barrels in their design. This feature permits checking the bore for ammunition, easy cleaning of the bore, and loading individual projectiles into the bore and omits crossholes in the bore which adversely affect accuracy. However, if the barrel does not return to the exact location after each shot due to designed tolerances or wear, the accuracy of the gun will be erratic. Furthermore, retention of the barrel in the firing position must be sufficient to withstand the forces encountered during firing without barrel movement for optimum accuracy. Inadvertent impact on the barrel may cause premature wear to occur in the pivot and locking mechanism, thereby causing a decline in accuracy or a shift in barrel lock up location.

The invention provides a pivoting barrel and cocking mechanism which is characterized by optimum accuracy, ease of operation, and simplicity in structure. A lever is pivotally mounted on the gun and retains the barrel in the firing position. When the lever is pivoted to unlock the barrel, the barrel pivots automatically to a loading position and the lever cocks the hammer. When the barrel is pivoted back to the firing position, the lever is returned to the locking position. The firing position of the barrel is controlled by a V block on the gun, and the locking force of the lever can be controlled by an adjusting screw. The barrel is spring-loaded to eliminate play at the pivot, and a sealing gasket seals the breech end of the barrel in the firing position. The sides of the barrel are protected against inadvertent impact by the frame of the gun.

DESCRIPTION OF THE DRAWINGS

The invention will be explained in conjunction with an illustrative embodiment shown in the accompanying drawing, in which

FIG. 10 is a sectional view taken along the line 10—10 of FIG. 7;

FIG. 11 is a sectional view taken along the line 11—11 of FIG. 7;

FIG. 12 is a sectional view taken along the line 12—12 of FIG. 7;

FIG. 13 is a side elevational view of the gun frame and barrel assembly with the cover plate of the frame removed;

FIG. 14 is a top plan view of the gun frame and barrel assembly of FIG. 13;

FIG. 15 is a sectional view of the hammer;

FIG. 16 is an end view of the hammer taken along the line 16—16 of FIG. 15;

FIG. 17 is a plan view of the lever pad;

FIG. 18 is an top plan view of the V block; and

FIG. 19 is a side view of the V block taken along the line 19—19 of FIG. 18.

DESCRIPTION OF SPECIFIC EMBODIMENT

Figure 1:
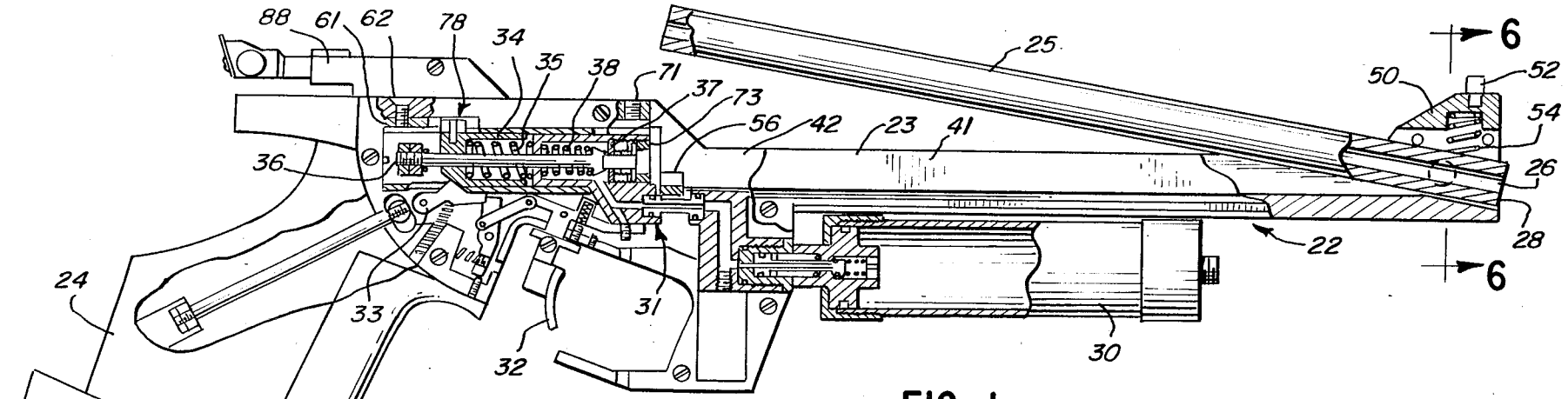
FIG. 1 is a side elevational view, partially broken away, of a gun formed in accordance with the invention showing the barrel in the loading position.

Referring to FIGS. 1-4, a gun 22 includes a frame 23, a grip or handle 24 attached to the frame, and a barrel 25 which is pivotally mounted on the frame. The barrel has a bore 26, a breech end 27, and a muzzle end 28 and pivots between a loading position illustrated in FIG. 1 and a firing position illustrated in FIG. 3.

Figure 5:
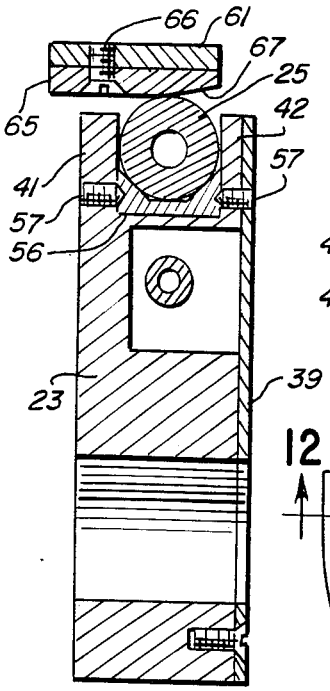
FIG. 5 is a sectional view taken along the line 5—5 of FIG. 3.

The particular gun illustrated is a gas-powered gun and includes $CO_2$ reservoir 30 for storing pressurized $CO_2$ and a valve assembly 31 for storing a charge of pressurized $CO_2$ until the gun is fired. The charge of pressurized $CO_2$ within the valve assembly 31 is released by pulling the trigger 32 which causes sear 33 to pivot downwardly. Hammer 34 is thereby released and is driven to the left by hammer spring 35. When the hammer hits the left end of valve stem 36, the right end of the valve stem moves to the left away from the valve seal 37 and against the bias of valve spring 38. The pressurized $CO_2$ within the valve assembly flows into the breech end of the barrel and propels a projectile out of the barrel. The details of the valve assembly, trigger, and sear are known in the art and need not be explained herein. A cover plate 39 (FIG. 5) is attached to the right side of the frame by screws to conceal the firing mechanism.

Figure 6:
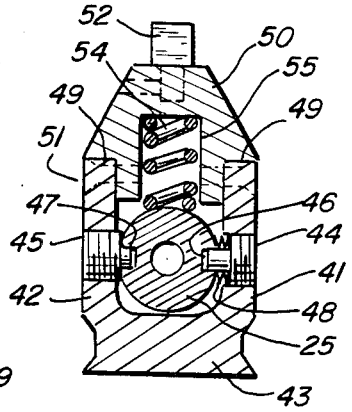
FIG. 6 is a sectional view taken along the line 6—6 of FIG. 3.

The frame 23 includes a channel-shaped barrel-holding portion 40 which extends forwardly from the valve assembly 31. The barrel-holding portion 40 includes a pair of side walls 41 and 42 and a bottom wall 43 (FIG. 6). Referring to FIG. 6, the barrel 25 is pivotally mounted adjacent its muzzle end by a pair of screws 44 and 45 which are screwed into the side walls 41 and 42 of the frame. The screws 44 and 45 terminate in pivot pins 46 and 47 which extend into counterbores in the sides of the barrel. Four Belleville spring washers 48 are mounted on the pivot pin 46 and force the barrel against the pivot pin 47. The spring washers provide a nominal 30 pound force on the barrel and eliminate side play of the barrel.

The forward end of the side walls 41 and 42 of the barrel portion of the frame extend upwardly above the barrel to provide sight-mounting lugs 49 (see also FIG. 14). A front sight 50 is mounted on the lugs 49 by screws 51. A sight pin 52 extends upwardly from the sight.

A coil spring 54 is positioned in a counterbore 55 in the sight 50 and engages the barrel forwardly of the pivot pins 46 and 47. The spring 54 loads the barrel with a nominal 50 pound force and eliminats vertical play between the barrel and the pivot pins. The spring 54 also biases the barrel to pivot to the loading position illustrated in FIG. 1.

The firing position of the barrel is fixed by a V block 56 (FIGS. 1, 3, 5, 18, and 19). The V block is mounted between the side walls 41 and 42 of the frame by screws 57 (FIG. 5) which extend through the side walls into counter sinks 58 (FIG. 19) in the V block. The V block includes diverging side walls 59 (FIG. 18) which form a generally V-shaped recess having an included angle of 90°. The side walls 59 of the V block engage the barrel when the barrel is in the firing position and provide a fixed position for the barrel. The V block is advantageously formed from sintered iron.

Figure 2:
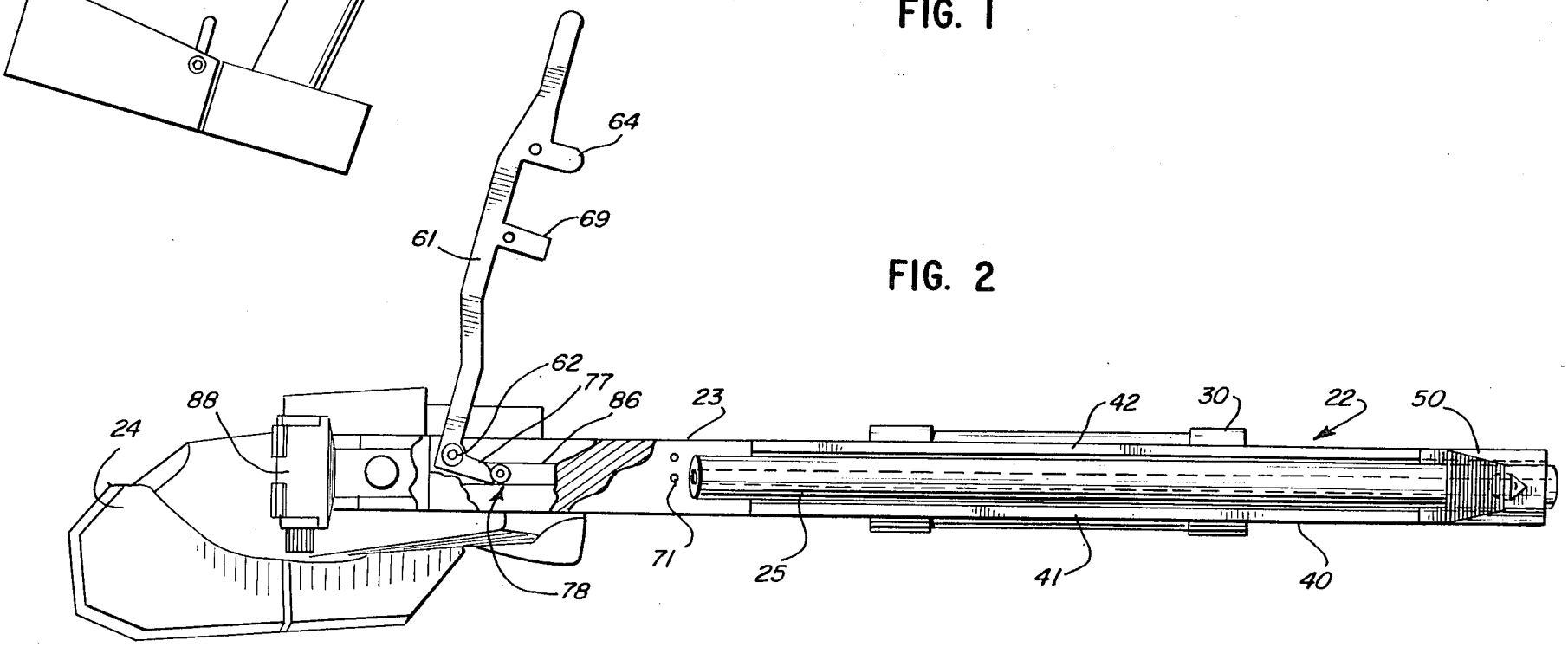
FIG. 2 is a top plan view, partially broken away, of the gun of FIG. 1.
Figure 4:
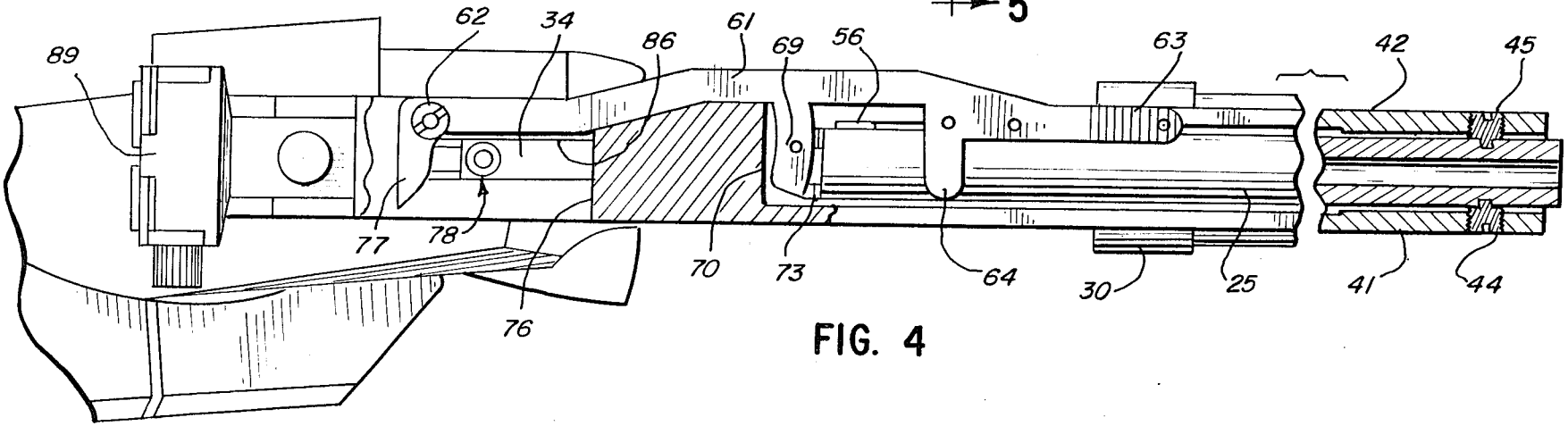
FIG. 4 is a top plan view, partially broken away, of the gun of FIG. 3.

The barrel is retained in the firing position by a pivoting lever 61 (FIGS. 2 and 4). The lever is pivotally mounted on the frame 23 by a screw 62 and pivots between a barrel-locking position illustrated in FIG. 4 and an unlocking position illustrated in FIG. 2. The outer end 63 of the lever is knurled to facilitate gripping the lever.

A retaining finger 64 on the lever 61 is engageable with the top of the barrel for holding the barrel against the V block 56. A lever pad 65 (FIGS. 5 and 17) is attached to the lever by a pair of screws 66, and the end of the pad which first engages the barrel is beveled at 67 (FIG. 5) to cam the barrel downwardly as the lever moves into the locking position. The lever pad is formed from material which is abrasion-resistant and has a low coefficient of friction such as acetal or urethane. In one specific embodiment black Delrin 100 was used.

Figure 8:
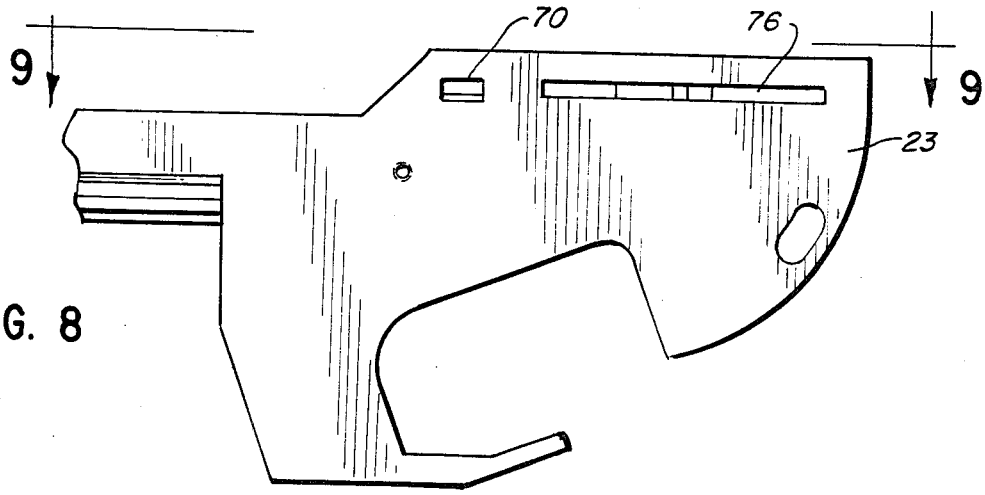
FIG. 8 is a fragmentary left side elevational view of the gun frame.

The lever 61 also includes an adjusting finger 69 which extends into a slot 70 (FIGS. 8, 10, and 12) in the frame. An adjusting screw 71 (FIGS. 1–3) extends downwardly into the slot 70 for adjusting the vertical position of the adjusting finger 69 and the lever relative to the V block 56.

Figure 3:
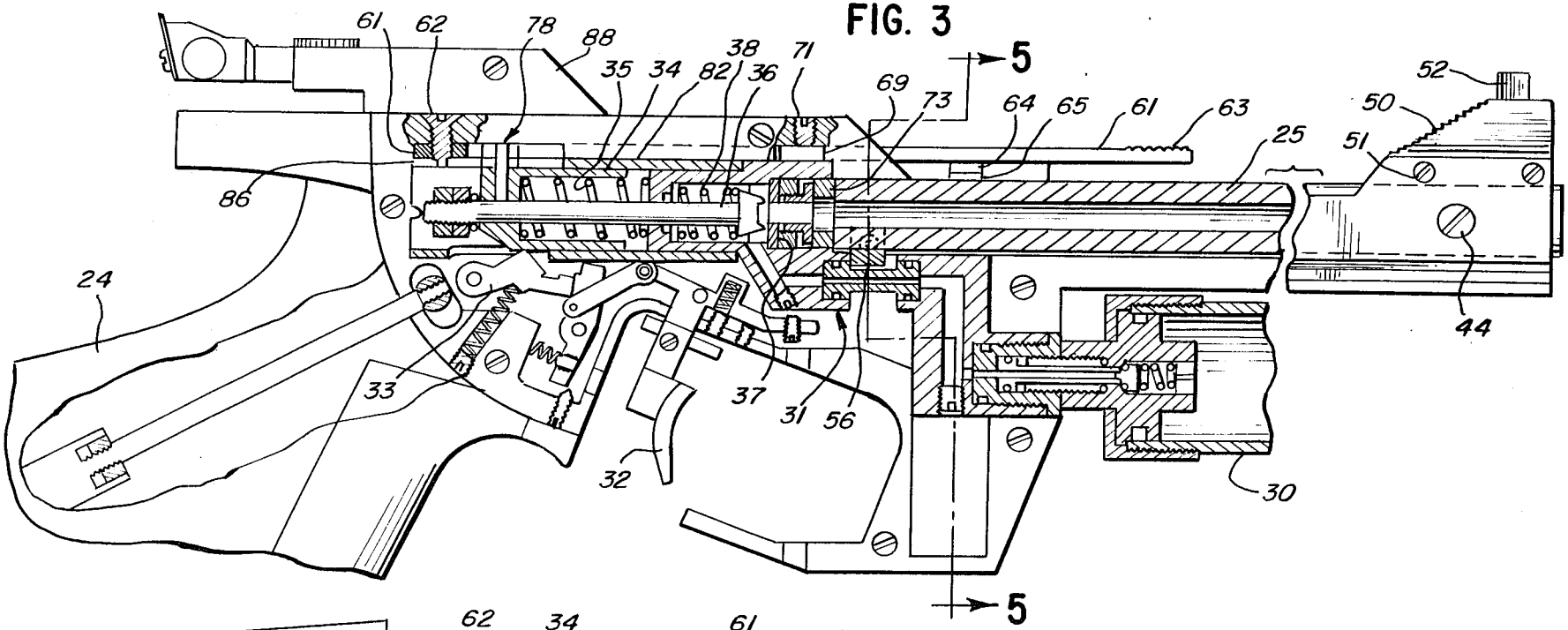
FIG. 3 is a view similar to FIG. 1 showing the gun in the firing position.

When the barrel is in the firing position, the breech end of the barrel is sealingly engaged by an annular sealing gasket 73 (FIGS. 1 and 3). The sealing gasket is mounted in a cylindrical recess formed by the front end of the valve assembly 31 and provides a gastight seal between the valve assembly and the barrel, thereby eliminating leakage of air when the gun is fired. The valve assembly is mounted within a generally cylindrical chamber 74 (FIGS. 10 and 11) which is formed by the frame 23 and the frame cover plate 39.

Figure 7:
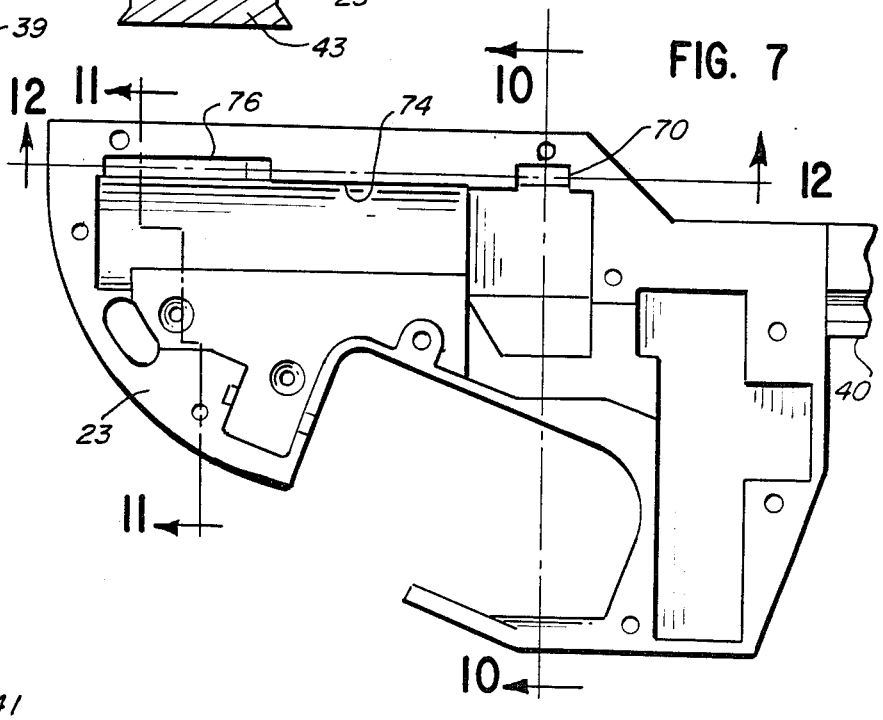
FIG. 7 is a fragmentary right side elevational view of the gun frame without the cover plate of the frame.

The rear end of the lever 61 is positioned in a slot 76 (FIGS. 7, 8, and 12) in the frame 23. A cocking arm 77 (FIGS. 2 and 4) extends from the rear end of the lever away from the pivot screw 62. The cocking arm 77 is engageable with a pin assembly 78 which is attached to the hammer 34.

Referring to FIGS. 15 and 16, the hammer 34 is generally cylindrical and includes a cylindrical side wall 79 and a rear wall 80. The hammer is reciprocably mounted on the valve stem 36 by means of an opening 81 in the rear wall 80 through which the valve stem extends. The hammer is enclosed by and reciprocates within a hammer tube 82 (FIG. 3) which is mounted within the recess 74 of the frame.

The pin assemby 78 includes a pair of rollers 83 and 84 and a pin 85 which rotatably mounts the rollers. The pin assembly 78 extends perpendicularly to the direction of reciprocation of the hammer through a slot 86 (FIGS. 2 and 4) in the hammer tube 82 and into the slot 76 in which the lever 61 is mounted. As the lever moves from its locking position in FIG. 4 to its unlocking position in FIG. 2, the cocking arm engages the upper roller 83 and moves the hammer forwardly. The hammer is retained in the forward or cocked position by the sear 33, and the hammer will remain cocked as the lever is moved back to its locking position.

Figure 9:
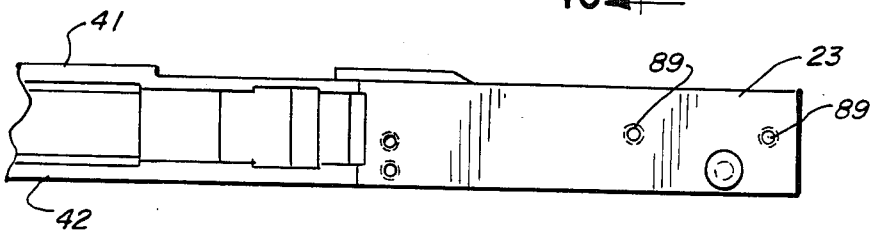
FIG. 9 is a fragmentary top plan view taken along the line 9—9 of FIG. 8.

A rear sight 88 is mounted on the frame by screws which extend into screw holes 89 (FIG. 9) in the top of the frame.

OPERATION

The operation of the pivoting barrel and the cocking mechanism is apparent from the foregoing description. When the lever 61 is moved to its unlocking position, the spring 54 at the muzzle end of the barrel pivots the barrel to the loading position shown in FIG. 1. The bore of the barrel can be cleaned if desired, and a projectile can be loaded into the breech end of the barrel. Movement of the lever to the unlocking position also cocks the hammer 34.

After the barrel is loaded, it is pivoted back to the firing position, and the lever 61 is pivoted back to the locking position. When the retaining finger 64 engages the barrel, the barrel is forced against the V block 56, and the position of the barrel relative to the valve assembly 31 is fixed. The retention force can be adjusted periodically by the adjusting screw 71. The barrel is thereby retained in the same firing position for each firing and is prevented from moving during firing.

The side walls 41 and 42 of the barrel portion of the frame protect the barrel against inadvertent impact. The Belleville spring washers 48 and the coil spring 54 eliminate play of the barrel in any direction.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A gun comprising:

a frame, a barrel including a muzzle end and a breech end pivotally secured to the frame on a pivot axis adjacent the muzzle end for movement about the pivot axis between firing and loading positions, a spring mounted on the frame, between the muzzle end and the pivot axis, said spring mounted on the frame above the barrel and engaging the barrel adjacent the muzzle end for biasing the muzzle end of the barrel upwardly to the loading position, and a lever pivotally mounted on the frame to a further pivot axis rearward of the breech end of the barrel for pivoting movement about the further axis, said further axis extending perpendicularly to the pivot axis of the barrel, the lever being movable between a locking position in which the lever engages the barrel and retains the barrel in the firing position and an unlocking position in which the lever is disengaged from the barrel to permit the barrel to pivot.

2. The gun of claim 1 including a resilient and compressible sealing gasket mounted on the frame for sealingly engaging the breech end of the barrel when the barrel is in the firing position.

3. The gun of claim 1 including a pair of pivot pins mounted on the frame adjacent the muzzle end of the barrel for pivotally mounting the barrel, said gum further including a second spring adjacent one of the pivot pins for biasing the barrel toward the other pivot pin.

4. A gun comprising:

a frame, a barrel pivotally mounted on the frame to a pivot axis for movement about the pivot axis between firing and loading positions, a lever pivotally mounted on the frame to a further pivot axis for pivoting movement about the further axis, said further axis extending perpendicularly to the pivot axis of the barrel, the lever being movable between a locking position in which the lever engages the barrel and retains the barrel in the firing position and an unlocking position in which the lever is disengaged from the barrel to permit the barrel to pivot, and a V block mounted on the frame, the V block having a generally V-shaped recess with a pair of inclined side walls, the barrel engaging the side walls of the V block when the barrel is in the firing position.

5. A gun comprising:

a frame, a barrel pivotally mounted on the frame to a pivot axis for movement about the pivot axis between firing and loading positions, a lever pivotally mounted on the frame to a further pivot axis for pivoting movement about the further axis, said further axis extending perpendicularly to the pivot axis of the barrel, the lever being movable between a locking position in which the lever engages the barrel and retains the barrel in the firing position and an unlocking position in which the lever is disengaged from the barrel to permit the barrel to pivot, and a hammer reciprocably mounted in the frame for movement between cocked and uncocked positions, said lever including cocking means for engaging the hammer and moving the hammer to the cocked position as the lever pivots.

6. The gun of claim 5 including a sear mounted on the frame for retaining the hammer in the cocked position.

7. The gun of claim 5 including a hammer pin extending from the hammer perpendicularly to the direction of movement of the hammer, said cocking means engaging the hammer pin.

8. The gun of claim 5 including a pivot pin on the frame for pivotally mounting the lever, said cocking means of the lever being positioned on one side of the pivot pin, the lever including a retaining finger on the other side of the pivot pin for engaging the barrel whereby the cocking means moves the hammer to the cocked position as the lever pivots to the unlocking position and the retaining finger engages the barrel as the lever pivots to the locking position.

9. The gun of claim 8 including a lever pad mounted on the lever, the lever pad being formed of low-friction and abrasion-resistant material and engaging the barrel when the barrel is in the firing position and the lever is in the locking position.

10. The gun of claim 8 in which the lever includes an adjusting finger between the retaining finger and the pivot pin, the adjusting finger being positioned in a slot in the frame when the lever is in the locking position, and adjusting means on the frame engageable with the adjusting finger for adjusting the position of the lever relative to the barrel.

11. The gun of claim 10 in which said adjusting means comprises a screw on the frame which is movable in a direction which is perpendicular to the pivot axis of the barrel.

* * * * *